US010491975B2

(12) United States Patent
Graff et al.

(10) Patent No.: US 10,491,975 B2
(45) Date of Patent: Nov. 26, 2019

(54) ACOUSTIC TRANSDUCER SYSTEM

(71) Applicant: Bose Corporation, Framingham, MA (US)

(72) Inventors: Allen Graff, Sutton, MA (US); Zhen Xu, Ashland, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/789,128

(22) Filed: Oct. 20, 2017

(65) Prior Publication Data

US 2019/0124428 A1 Apr. 25, 2019

(51) Int. Cl.

| | |
|---|---|
| ***H04R 1/02*** | (2006.01) |
| ***H04R 5/02*** | (2006.01) |
| ***H04R 1/28*** | (2006.01) |

(52) U.S. Cl.

CPC ..... *H04R 1/025* (2013.01); *H04R 1/02* (2013.01); *H04R 1/026* (2013.01); *H04R 1/28* (2013.01); *H04R 5/02* (2013.01); *H04R 2499/11* (2013.01)

(58) Field of Classification Search

CPC ..... H04R 1/02; H04R 1/025; H04R 1/026; H04R 1/28; H04R 1/2811; H04R 1/2873; H04R 2201/02; H04R 2499/15; H04R 5/02; H04R 2499/11

USPC ..... 381/87, 333, 353, 354, 386, 388, 392, 381/398; 181/150, 151, 171, 172

See application file for complete search history.

(56) References Cited

U.S. PATENT DOCUMENTS

| | | | | |
|---|---|---|---|---|
| 4,433,214 A | | 2/1984 | Jasinski | |
| 4,939,783 A | * | 7/1990 | Dunning | H04R 1/2873 181/150 |
| 5,115,884 A | * | 5/1992 | Falco | H04R 1/2819 181/151 |
| 5,687,247 A | | 11/1997 | Proni | |
| 5,689,574 A | * | 11/1997 | Heirich | G06F 1/1605 381/300 |

(Continued)

FOREIGN PATENT DOCUMENTS

| | | | |
|---|---|---|---|
| DE | 2334665 | C3 | 10/1980 |
| DE | 102012106144 | B4 | 7/2012 |

(Continued)

OTHER PUBLICATIONS

International Search Report and the Written Opinion of the International Searching Authority, International Application No. PCT/US2018/054951, pp. 1-16, dated Jan. 8, 2019.

*Primary Examiner* — Huyen D Le

(74) *Attorney, Agent, or Firm* — Bond, Schoeneck & King, PLLC

(57) ABSTRACT

An acoustic system includes a housing includes an acoustic element opening with an inner edge extending from a first, outer surface of the housing to a second, inner surface of the housing, and an acoustic element having an acoustic element foam layer extending at least partially along a circumferential perimeter of the acoustic element, where the acoustic element foam layer is configured to engage the inner edge of the acoustic element opening when the acoustic element is positioned within the opening, and where the acoustic element foam layer is compressed in a direction perpendicular to a central axis of the acoustic element when the acoustic element is positioned within the opening, such that an acoustic seal is created.

22 Claims, 9 Drawing Sheets

(56) References Cited

U.S. PATENT DOCUMENTS

| | | | | |
|---|---|---|---|---|
| 5,949,898 | A | 9/1999 | Proni | |
| 6,568,503 | B2 | 5/2003 | Proni | |
| 7,031,487 | B2 | 4/2006 | Stiles | |
| 7,120,265 | B2 | 10/2006 | Sperle et al. | |
| 7,221,772 | B2 | 5/2007 | Evenisse et al. | |
| 7,292,706 | B2 * | 11/2007 | Hamada ..... | H04R 1/025 381/386 |
| 7,548,631 | B2 | 6/2009 | Espiritu | |
| 8,073,185 | B2 | 12/2011 | Watanabe et al. | |
| 8,094,865 | B2 | 1/2012 | Espiritu | |
| 2013/0010994 | A1 | 1/2013 | Liang | |
| 2015/0055027 | A1 | 2/2015 | Suzuki et al. | |
| 2015/0125024 | A1 | 5/2015 | Espiritu | |
| 2015/0201258 | A1 | 7/2015 | Han et al. | |
| 2017/0208395 | A1 | 7/2017 | Wan et al. | |

FOREIGN PATENT DOCUMENTS

| | | | |
|---|---|---|---|
| DE | 102012106144 | B4 | 4/2014 |
| EP | 1322134 | | 6/2003 |
| GB | 2399977 | | 9/2004 |
| JP | 4562586 | B2 | 11/2006 |
| JP | 4562586 | B2 | 10/2010 |
| WO | 2006013311 | | 2/2006 |

* cited by examiner

ACOUSTIC TRANSDUCER SYSTEM

BACKGROUND

The disclosure relates to an acoustic system with a housing configured to generate an acoustic seal around an acoustic transducer or a passive radiator.

SUMMARY

All examples and features mentioned below can be combined in any technically possible way.

In one aspect, an acoustic system includes: (i) a housing comprising an acoustic element opening, the acoustic element opening comprising an inner edge extending from a first, outer surface of the housing to a second, inner surface of the housing; and (ii) an acoustic element (e.g., an acoustic transducer and/or a passive acoustic element) comprising an acoustic element foam layer extending at least partially along a circumferential perimeter of the acoustic element, where the acoustic element foam layer is configured to engage the inner edge of the acoustic element opening when the acoustic element is positioned within the opening; where the acoustic element foam layer is compressed in a direction perpendicular to a central axis of the acoustic element when the acoustic element is positioned within the opening, such that an acoustic seal is created.

Embodiments may include one of the following features, or any combination thereof. The circumferential perimeter of the acoustic element may include a substantially flat upper edge having a first end and a second end, and the acoustic element foam layer may include a first end and a second end, the first end of the acoustic element foam layer configured to be flush with the first end of the flat upper edge, and the second end of the acoustic element foam layer configured to be flush with the second end of the flat upper edge.

Embodiments may include one of the following features, or any combination thereof. The housing may include a removable upper portion having a housing foam layer configured to align with at least a portion of the acoustic element opening when the acoustic element is positioned within the opening, such that an acoustic seal is created.

Embodiments may include one of the following features, or any combination thereof. The housing foam layer may include a first portion configured to align with a first portion of the acoustic element foam layer, and may further include a second portion configured to align with a second portion of the acoustic element foam layer, and where the housing foam layer extends along less than all of the length of the flat upper edge of the acoustic element.

Embodiments may include one of the following features, or any combination thereof. At least a portion of the inner edge of the opening may include a ridge configured to compress the acoustic element foam layer when the acoustic element is positioned within the opening. The ridge may be triangular. The acoustic element foam layer may extend along the entire circumferential perimeter of the acoustic element. The acoustic element foam layer may be wider than the inner edge of the opening. The acoustic element foam layer may be approximately 1.5 mm thick.

Embodiments may include one of the following features, or any combination thereof. The acoustic element may include a flange portion configured to inhibit movement of the acoustic element relative to the outer surface of the housing. The flange portion may be positioned in front of the opening when the acoustic element is positioned within the opening.

In another aspect, an acoustic system includes: (i) a housing including an acoustic element opening, the acoustic element opening comprising an inner edge extending from a first, outer surface of the housing to a second, inner surface of the housing, where the inner edge comprises a housing foam layer; and (ii) an acoustic element (e.g., an acoustic transducer and/or a passive acoustic element) including a circumferential perimeter, where the circumferential perimeter of the acoustic element is configured to engage the housing foam layer of the opening when the acoustic element is positioned within the opening; where the housing foam layer is compressed in a direction perpendicular to a central axis of the acoustic element when the acoustic element is positioned within the opening, such that an acoustic seal is created.

Embodiments may include one of the following features, or any combination thereof. At least a portion of the circumferential perimeter of the acoustic element may include a ridge configured to compress the acoustic element foam layer when the acoustic element is positioned within the opening. The ridge may be triangular.

Embodiments may include one of the following features, or any combination thereof. The circumferential perimeter of the acoustic element may include a substantially flat upper edge having a first end and a second end, where the housing foam layer includes a first end and a second end, the first end of the housing foam layer configured to be flush with the first end of the flat upper edge, and the second end of the housing foam layer configured to be flush with the second end of the flat upper edge.

Embodiments may include one of the following features, or any combination thereof. The housing may include a removable upper portion having an upper housing foam layer configured to align with at least a portion of the acoustic element opening when the acoustic element is positioned within the opening, such that an acoustic seal is created. The upper housing foam layer may include a first portion configured to align with a first portion of the housing foam layer, and may include a second portion configured to align with a second portion of the housing foam layer, where the upper housing foam layer extends along less than all of the length of the flat upper edge of the acoustic element. The acoustic element foam layer may be wider than the inner edge of the opening. The acoustic element foam layer may be approximately 1.5 mm thick.

In another aspect, a speaker assembly includes: (i) an acoustic element (e.g., an acoustic transducer and/or a passive acoustic element) comprising a diaphragm comprising a motion axis and a frame; a surround coupling the diaphragm to the frame; (ii) a housing defining an opening for receiving the acoustic element, the housing comprising a card slot, adjacent the opening, for receiving the frame to inhibit movement of the frame relative to the housing; and (iii) a first layer of foam disposed within the opening and separate from an interface between the frame and the card slot, where the first layer of foam is configured to provide an acoustic seal for the acoustic element.

Embodiments may include one of the following features, or any combination thereof. The housing may include a wall that defines the opening for receiving the acoustic element, and the wall may include a first, outer surface that lies in a first plane and a second, inner surface that lies in a second plane substantially parallel to the first plane, and an edge that extends from the first surface to the second surface in a direction perpendicular to the first and second planes to define the opening, where the first layer of foam is disposed between the edge and the acoustic element.

Embodiments may include one of the following features, or any combination thereof. The housing may be configured to apply a compressive force to the first layer of foam. The compressive force may be substantially perpendicular to the motion axis. The first layer of foam may extend at least partially along a circumferential perimeter of the acoustic element. At least a portion of the edge may include a ridge configured to compress the first layer of foam when the acoustic element is positioned within the opening.

Embodiments may include one of the following features, or any combination thereof. The housing may include a removable upper portion that is coupled to the wall to apply the compressive force. The removeable upper portion may include a second layer of foam arranged to overlie the upper surface of the acoustic element.

Embodiments may include one of the following features, or any combination thereof. The acoustic element may be retained within the opening by: (i) a compressive force applied on the acoustic element via the housing; and (ii) the card slot.

Embodiments may include one of the following features, or any combination thereof. The circumferential perimeter of the acoustic element may include a substantially flat upper surface having a first end and a second end, where the first layer of foam includes a first end and a second end, the first end of the first layer of foam is arranged to be flush with the first end of the upper surface, and the second end of the first layer of foam is arranged to be flush with the second end of the upper surface.

Embodiments may include one of the following features, or any combination thereof. The acoustic element may include a flange portion configured to align the acoustic element within the opening and configured to be positioned in front of the opening when the acoustic element is positioned within the opening.

DETAILED DESCRIPTION

Acoustic transducer housings define a space for acoustic transducers and minimize acoustic leak. However, as the size of electronic devices and acoustic transducer housings gets progressively smaller while the size of acoustic transducers stays largely the same, minimizing acoustic leak is more difficult. There is a need for compact acoustic transducer systems that provide an acoustic seal.

Figure 1:
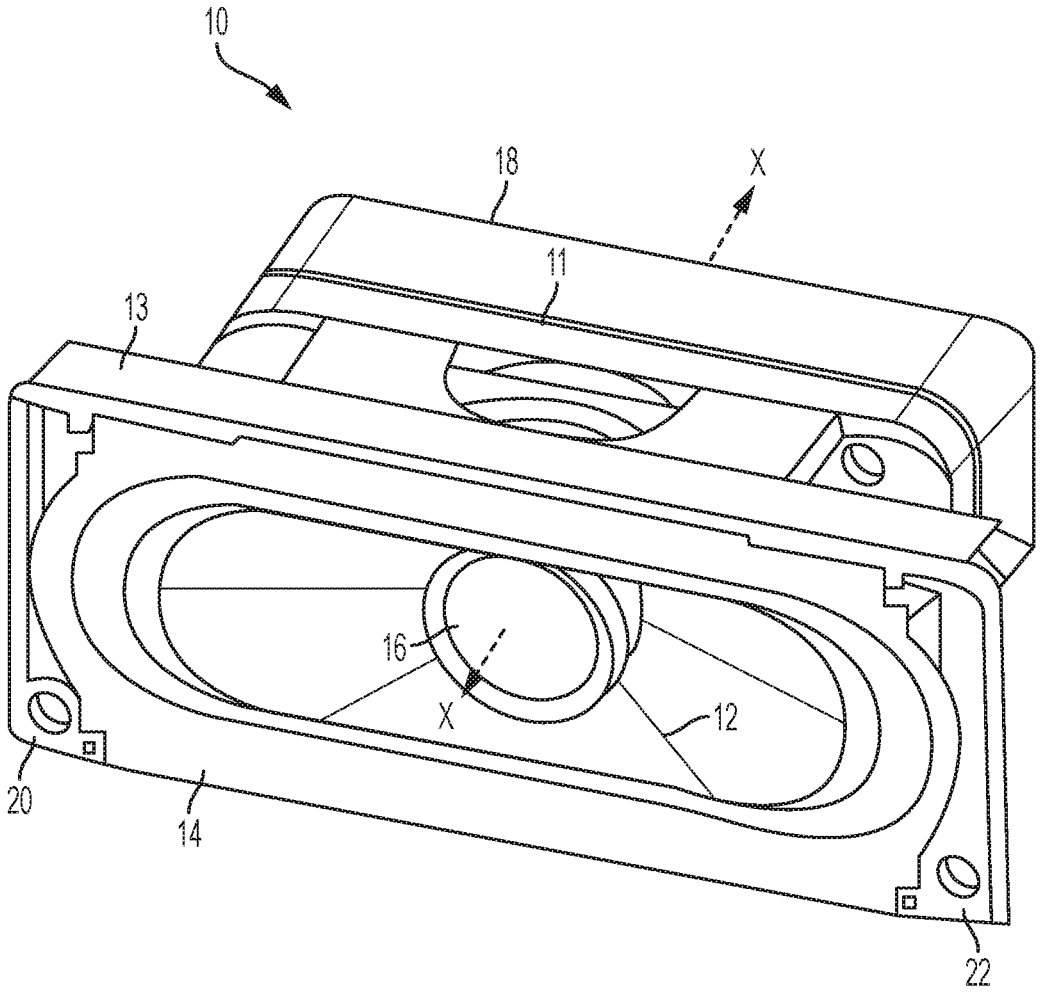
FIG. 1 is a schematic representation of a front view of an example acoustic transducer.

FIG. 1 is a schematic representation of a front view of an acoustic transducer 10. The acoustic transducer can comprise any of the elements or components described or otherwise envisioned herein. Acoustic transducer 10 comprises a circular conical diaphragm 12, a surround 14, and a dust cap 16, although many other shapes and configures of the acoustic transducer are possible. For example, the acoustic transducer may be round, oval, square, or any of a variety of other shapes and sizes. Acoustic transducer 10 comprises a central axis X-X that extends from the center of the dust cap 16 of the acoustic transducer to a back region 18 of the transducer. The acoustic transducer also includes an electromagnetic motor 11 that drives motion of the diaphragm along a motion axis, which is also along the central axis X-X.

The acoustic transducer comprises a frame 13 that surrounds at least a portion of the surround 14. According to an embodiment, frame 13 of the acoustic transducer 10 optionally comprises one or more flange portions 20 and/or 22. The flange portions may assist with positioning or retaining the acoustic transducer within a housing or other structure, and/or restricting or inhibiting movement of the acoustic transducer within the housing.

Figure 2:
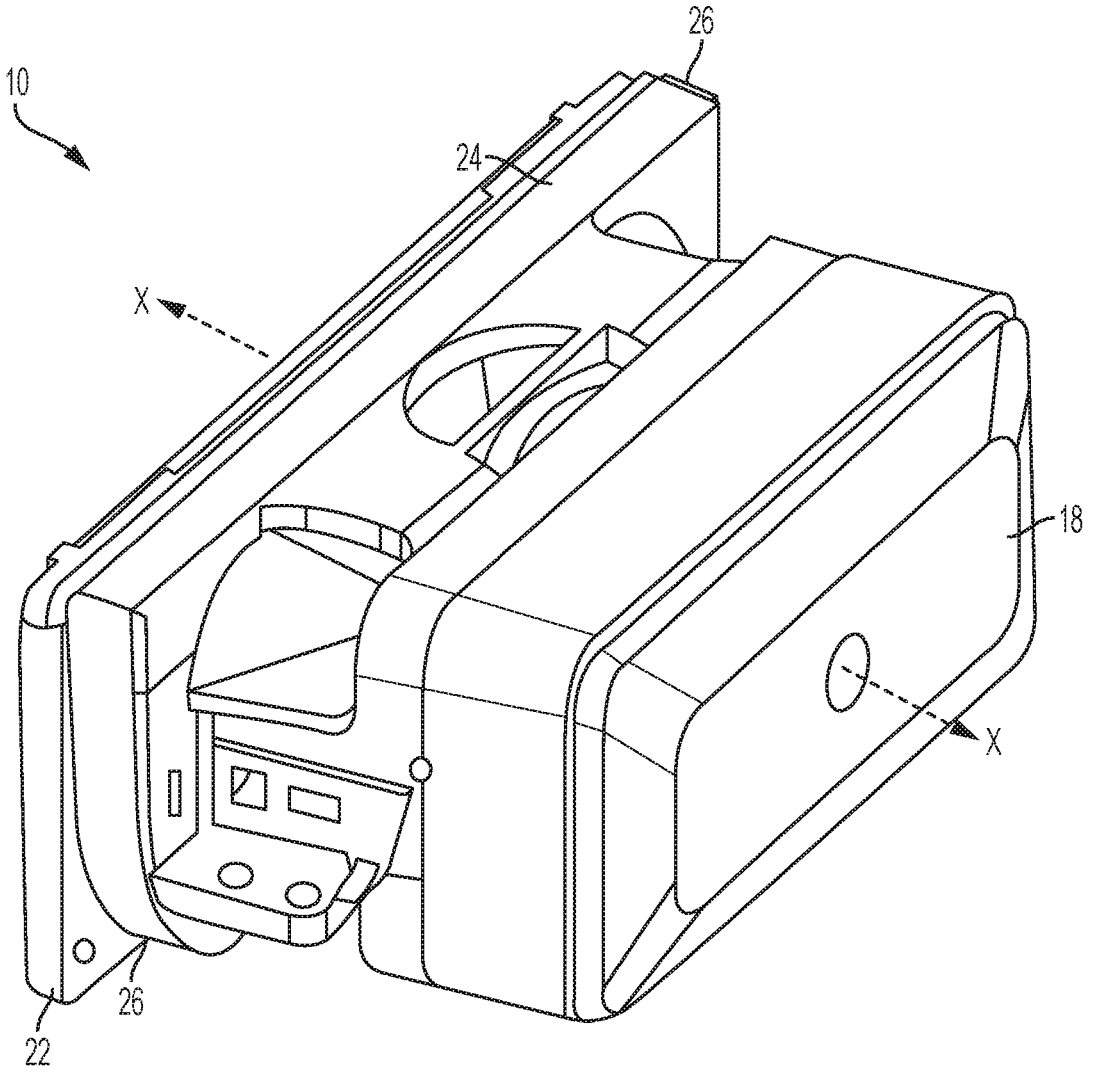
FIG. 2 is a schematic representation of a reverse view of an example acoustic transducer.

FIG. 2 is a schematic representation of a reverse view of an acoustic transducer 10. As shown in FIG. 1, acoustic transducer 10 comprises a central axis X-X that extends from the center of the dust cap of the acoustic transducer to the back region 18 of the transducer. In this embodiment, the acoustic transducer comprises a flange portion 22 of frame 13 extending outwardly at an angle perpendicular to the central axis X-X.

Acoustic transducer 10 also comprises a circumferential perimeter extending all around the device. According to an embodiment, the acoustic transducer is configured such that the circumferential perimeter is positioned to interface or interact with a housing or other retaining structure when the transducer is installed in the housing. The circumferential perimeter comprises a surface 24, an upper portion of which is shown in FIG. 2. The surface 24 may be substantially flat, or may be textured, or may comprise a variety of configurations. The circumferential perimeter and the substantially flat surface 24 are perpendicular to the central axis X-X of the acoustic transducer 10.

An acoustic element foam layer 26 is applied, installed, or manufactured along at least a portion of the length of the flat surface 24. The acoustic element foam layer may be composed of any material configured or sufficient to be flexible to allow the acoustic transducer to be installed in a housing, but is sufficiently rigid to create an acoustic seal and/or prevent acoustic leak when the acoustic transducer is installed in the housing. The foam material may be, for example, an elastomer that is applied to surface 24 and allowed to cure. As another example, a manufactured foam material is applied to surface 24 either manually or by an automated process. Many other foam materials and application processes are possible.

Figure 3:
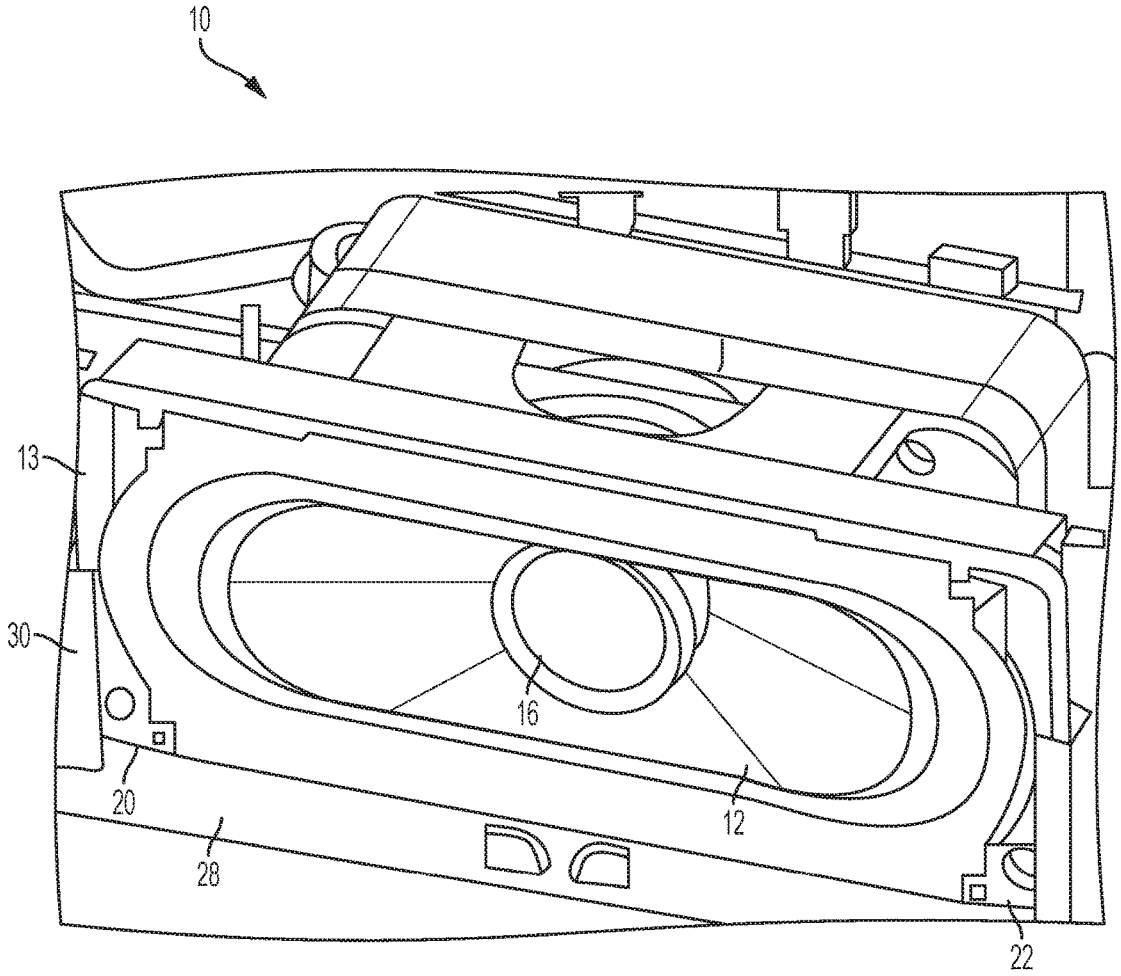
FIG. 3 is a schematic representation of a front view of an example acoustic transducer installed in a housing.

FIG. 3 is a schematic representation of an acoustic transducer 10 installed in a housing 28 or other positioning or receiving structure. Among many other embodiments, the housing 28 may be a sound bar or other electronic component requiring an acoustic transducer in a compact profile. The housing 28 optionally comprises a card slot 30 and/or other positioning structure that facilitates the positioning and/or retention of the acoustic transducer within the housing. As shown in FIG. 3, the foam layer is separate from an interface between the frame and the card slot. The acoustic transducer also comprises a frame 13 with one or more flange portions 20 and/or 22 that facilitate positioning of the acoustic transducer within the housing, and/or inhibit movement of the acoustic transducer within the housing. In this embodiment, the flange portion of the frame is positioned in front of the acoustic element opening when the acoustic transducer is positioned within the opening.

Figure 4:
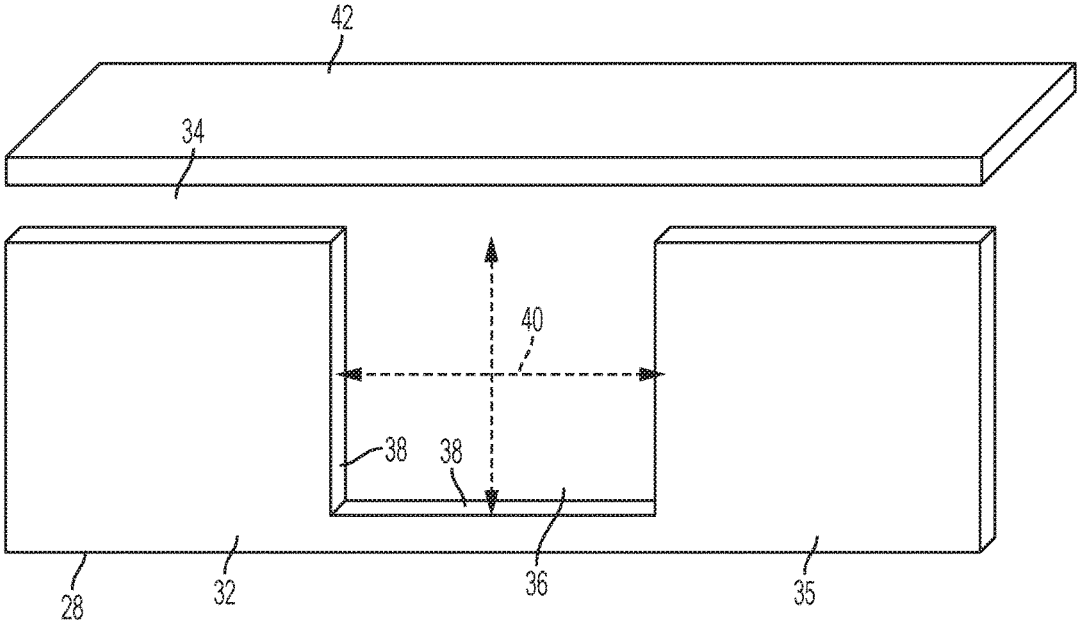
FIG. 4 is a schematic representation of a front view of an example acoustic transducer housing.

FIG. 4 is a schematic representation of a portion of a housing 28 for an acoustic transducer system, such as a sound bar or other electronic component comprising an acoustic transducer. The housing 28 may be substantially square, round, rectangular, or any other shape. The housing 28 comprises an outer panel 32 which may extend along a portion or an entirety of the outer perimeter of the housing. The housing defines an interior volume 34 configured to receive at least a portion of the one or more acoustic transducers, and the remainder of which may comprise other components or may be partially or completely empty. The housing 28 also comprises an upper portion 42 which may be configured to be removable to allow access to the interior volume 34. According to an embodiment, upper portion 42 is configured to provide an acoustic seal when installed or otherwise connected to a top surface of the outer panel 32.

According to an embodiment, the outer panel 32 defines an acoustic element opening 36 configured to receive an acoustic transducer 10. The acoustic element opening 36 comprises an inner edge 38 which defines an inner diameter 40 of the opening. Although shown as square in FIG. 4, it should be recognized that the acoustic element opening 36 may be any shape or size configured to receive the acoustic transducer. Inner edge 38 of the acoustic element opening 36 extends from a first, outer surface 35 of the housing to a second, inner surface 37 of the housing (shown in FIG. 5). As shown in FIG. 4, the inner edge 38 of the acoustic element opening 36 extends along a plane perpendicular to the plane of the first, outer surface 35 of the housing. Similarly, the inner edge 38 of the acoustic element opening 36 extends along a plane parallel to the central axis of the transducer. The inner edge 38 may comprise a wide variety of widths.

Figure 5:
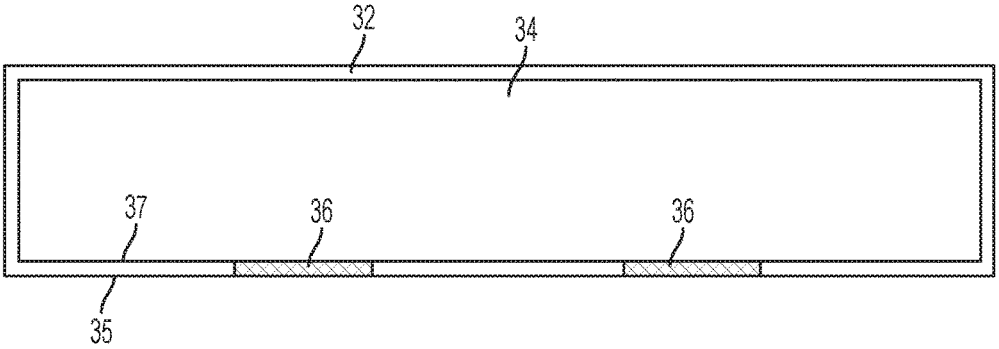
FIG. 5 is a schematic representation of a top view of an example acoustic transducer housing.

FIG. 5 is a top view of a housing 28 for an acoustic transducer system. In this embodiment, housing 28 is rectangular, and the upper portion 42 is removed or not yet installed or attached to the outer panel 32. The housing comprises a raised outer panel 32 that extends along the entire perimeter of the housing and defines an interior volume 34. The housing comprises two acoustic element openings 36, although more or fewer transducer openings are possible.

Figure 6:
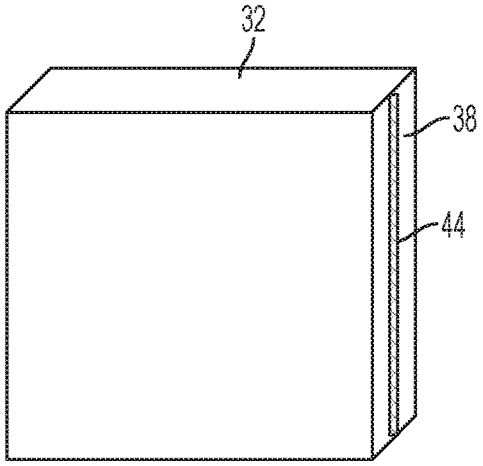
FIG. 6 is a schematic representation of a portion of an example acoustic transducer housing.
Figure 7:
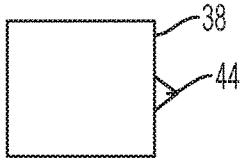
FIG. 7 is a schematic representation of a portion of an example acoustic transducer or acoustic transducer housing.

As shown in FIG. 6, one or more sides of the inner edge 38 may comprise a ridge 44 that facilitates the formation of an acoustic seal when the acoustic transducer is installed within the acoustic element opening. FIG. 7 is a top view of a portion of the housing showing the ridge 44 extending outwardly from the inner edge 38 of the acoustic element opening. As the acoustic transducer 10 is installed within the acoustic element opening 36, the acoustic element foam layer 26 on the acoustic transducer is compressed by the ridge 44 and an acoustic seal is formed. Although shown as triangular, ridge 44 may be any size or shape configured to facilitate the formation of an acoustic seal. For example, the ridge may be round, square, rectangular, or any other size or shape. In addition, there may be multiple ridges in a formation configured to further facilitate an acoustic seal.

Figure 8:
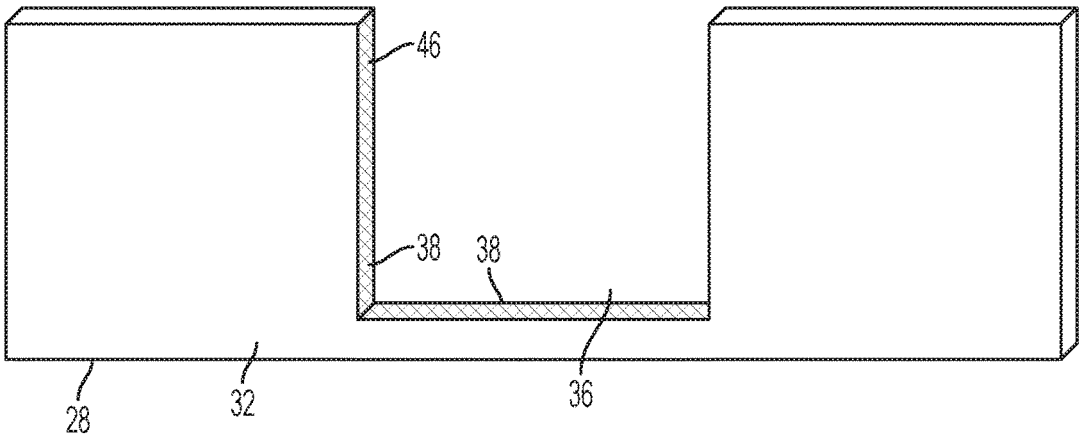
FIG. 8 is a schematic representation of a portion of an example acoustic transducer housing.

According to another embodiment, as shown in FIG. 8, the housing comprises a foam layer 46 rather than, or in addition to, the acoustic element foam layer 26 of the acoustic transducer. The foam layer 46 may be applied, installed, or manufactured along at least a portion of the length of the inner edge 38. The foam layer may be composed of any material configured or sufficient to be flexible to allow the acoustic transducer is installed in a housing, but is sufficiently rigid to create an acoustic seal and/or prevent acoustic leak when the acoustic transducer is installed in the housing. The foam material may be, for example, an elastomer that is applied to inner edge 38 and allowed to cure. As another example, a manufactured foam material is applied to inner edge 38 manually or by an automated process. Many other foam materials and application processes are possible.

In this embodiment, all or a portion of the surface 24 of the circumferential perimeter of the acoustic transducer may comprise a ridge 44 that compresses the foam layer 46 on the acoustic element opening to facilitate the formation of an acoustic seal.

Figure 9:
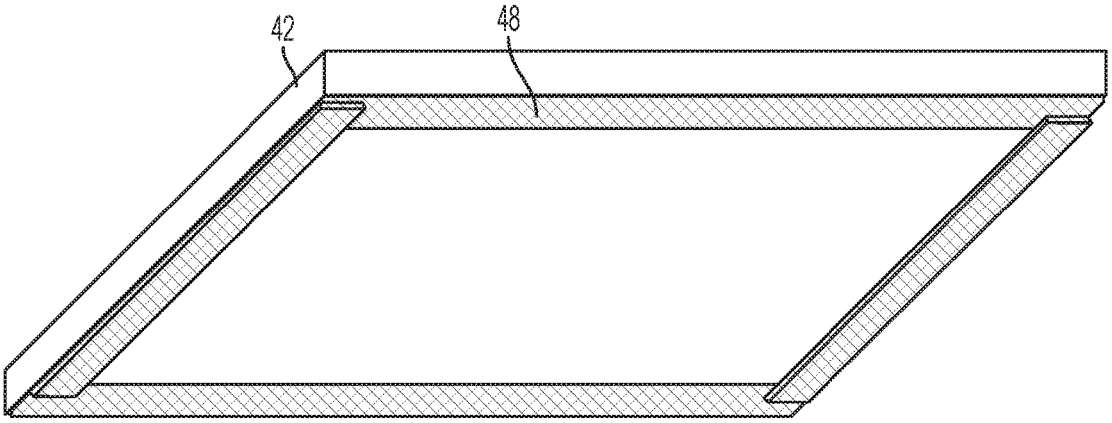
FIG. 9 is a schematic representation of a portion of an example acoustic transducer housing.

FIG. 9 is a view of the upper portion 42 of the housing 28. Upper portion 42 is configured to provide an acoustic seal when installed or otherwise connected to a top surface of the outer panel 32, and may be configured to be removable to allow access to the interior volume of the housing. According to an embodiment, upper portion 42 of the housing comprises a housing foam layer 48 along the entirety or a portion of the outer region of the upper portion. The foam layer is configured to engage the top surface of the outer panel 32 of the housing to create an acoustic seal when the upper portion is installed on the housing. According to an embodiment, all or a portion of the top surface of the outer panel 32 may comprise a ridge 44 that compresses the housing foam layer 48 of the upper portion and facilitates the formation of an acoustic seal.

Figure 10:
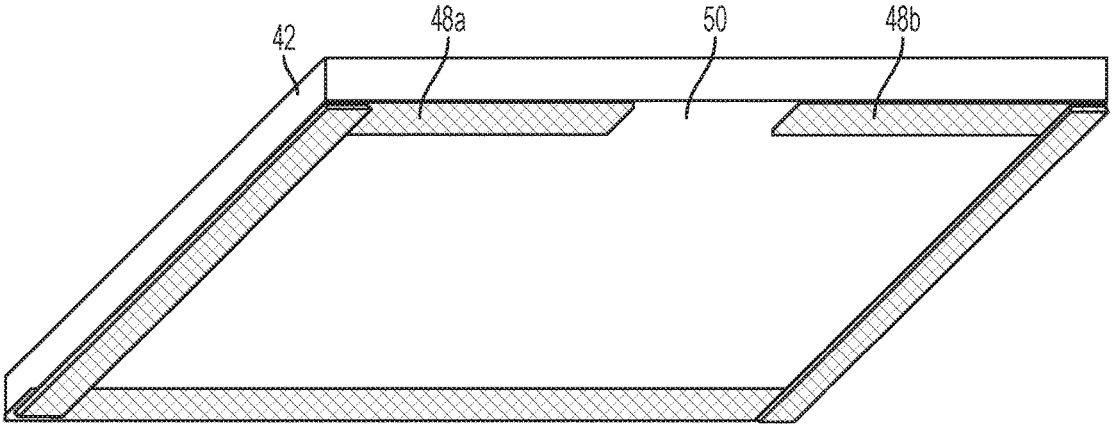
FIG. 10 is a schematic representation of a portion of an example acoustic transducer housing.

FIG. 10 is a view of the upper portion 42 of the housing 28. According to an embodiment, upper portion 42 of the housing comprises a housing foam layer 48 along less than all of the outer region of the upper portion. The housing foam layer 48 extends along the front lower edge region of the upper portion, but is not located along a notch region 50 of the upper portion. Accordingly, the upper portion 42 of the housing comprises a housing foam layer 48 with a first portion **48*a* configured to engage a first portion of the transducer and/or transducer foam layer, and further comprises a second portion 48*b*** configured to engage a second portion of the of the transducer and/or transducer foam layer.

Figure 11:
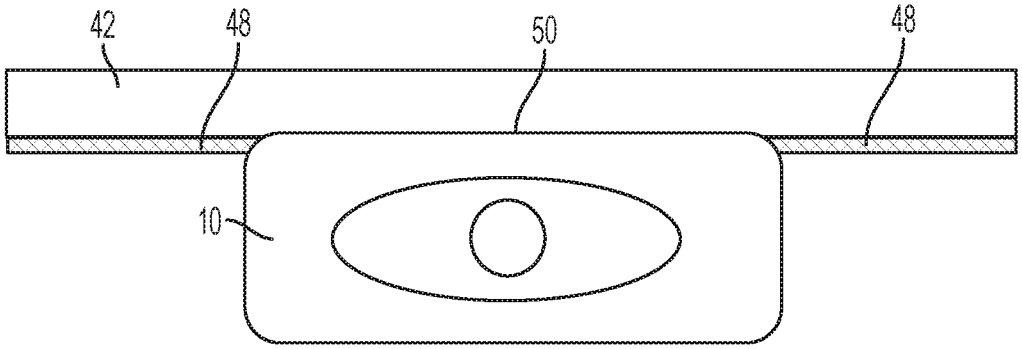
FIG. 11 is a schematic representation of a portion of an example acoustic transducer system.
Figure 12:
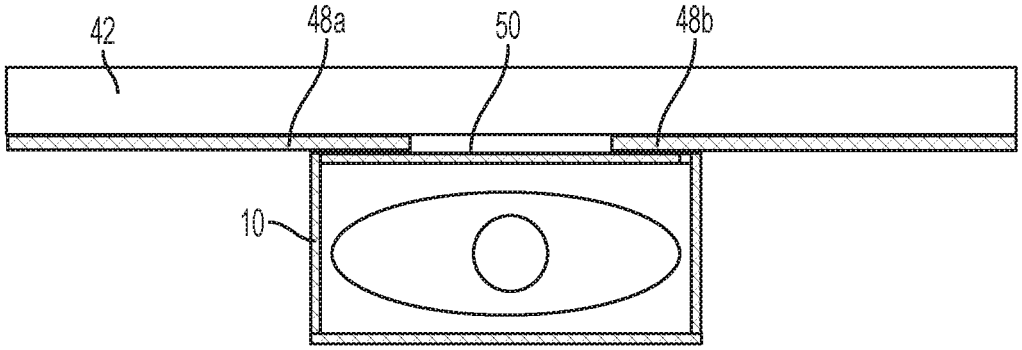
FIG. 12 is a schematic representation of a portion of an example acoustic transducer system.

As shown in FIG. 11, notch 50 is configured such that the notch aligns with the top central portion of the acoustic transducer 10 when the housing is assembled. For example, as shown in FIG. 12 with the front panel of the acoustic transducer removed and the circumferential perimeter of the acoustic transducer 10 shown with an acoustic element foam layer 26, notch 50 aligns with the top central portion of the acoustic transducer 10, which comprises a foam layer as shown in FIG. 3. The absence of a second foam layer in the region of notch 50 minimizes bowing of the upper portion when it is installed on the housing, and/or other undesirable cosmetic or structural impacts on the housing.

Figure 13:
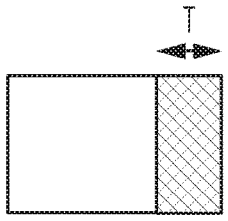
FIG. 13 is a schematic representation of a portion of an example acoustic transducer or acoustic transducer housing.

FIG. 13 is a schematic representation of a portion of acoustic transducer 10 or housing 28 with a foam layer. For example, FIG. 13 may be a portion of the surface 24 of the circumferential perimeter of the acoustic transducer with an acoustic element foam layer 26 applied, installed, or manufactured along at least a portion of the length of the flat surface 24. As another example, FIG. 13 may be a portion of the inner edge 38 of the acoustic element opening 36 with a foam layer 46 installed or manufactured along its length. As yet another example, FIG. 13 may be a portion of the upper portion 42 with a housing foam layer 48 installed or manufactured along its length. According to an embodiment, the thickness t of a foam layer described or otherwise envisioned herein may be adjusted to define an amount of compressive force required to install the acoustic transducer within the acoustic element opening. A thinner foam layer will require less compressive force, while a thicker foam layer will require more compressive force. The compressive force may be applied, for example, when the acoustic transducer is installed within the housing, and/or when the upper portion is secured or otherwise installed on or in the housing.

Figure 14:
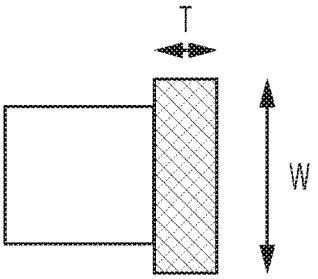
FIG. 14 is a schematic representation of a portion of an example acoustic transducer or acoustic transducer housing.

In addition to the thickness t of a foam layer, a width w of the foam layer may be adjusted to improve formation of an acoustic seal. FIG. 14 is a schematic representation of a portion of acoustic transducer 10 or housing 28 with a foam layer. According to an embodiment, the foam layer extends beyond the surface of the structure to which it is applied. Alternatively, the foam the layer covers less than all of the surface of the structure to which it is applied, and thus does not extend to the ends of the surface.

Many different sizes, thicknesses, and configurations of the foam layers described or otherwise envisioned herein are possible. According to an embodiment, a foam layer comprises a width w of approximately 5 mm. According to an embodiment, a foam layer comprises a thickness t of approximately 1.5 mm. For example, referring to FIG. 14, the width w of the foam layer is approximately 5 mm and the thickness t of the foam layer is approximately 1.5 mm. However, many other sizes, widths, lengths, and configurations of the foam layers are possible. Additionally, a housing and/or transducer may have a foam layer of variable sizes, widths, lengths, and configurations.

Figure 15:
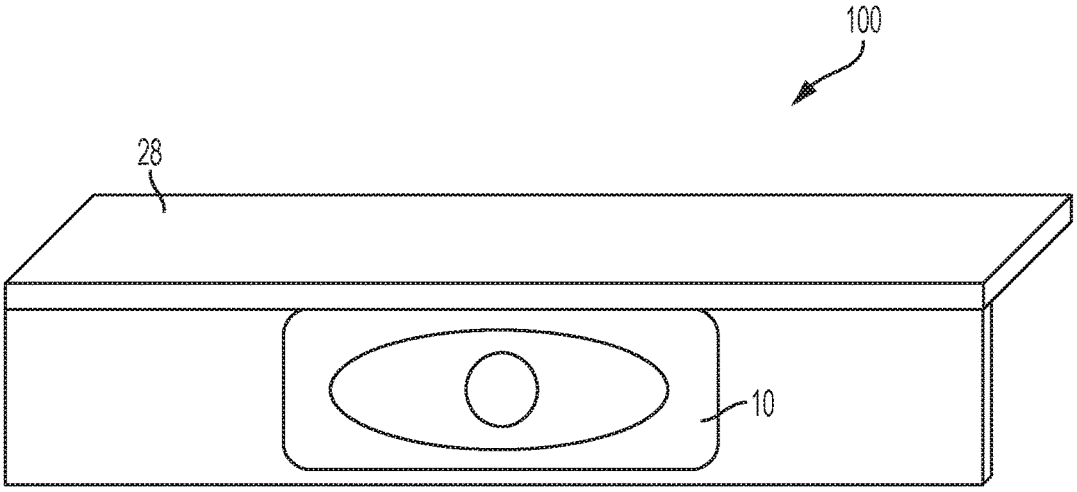
FIG. 15 is a schematic representation of a portion of an example acoustic transducer system.

FIG. 15 is a schematic representation of an acoustic transducer system 100, which may be a speaker assembly, comprising an assembled housing 28 with an installed acoustic transducer 10 according to any of the embodiments described or otherwise envisioned herein. Although not visible in FIG. 15, a foam layer is formed or applied between the acoustic transducer 10 and the housing 28. The foam layer may be applied on the circumferential perimeter of the acoustic transducer, on the inner edge of the acoustic element opening of the housing, and/or on the upper portion of the housing. This foam layer necessitates a compressive force that facilitates the formation of an acoustic seal to prevent or minimize acoustic leak.

Figure 16:
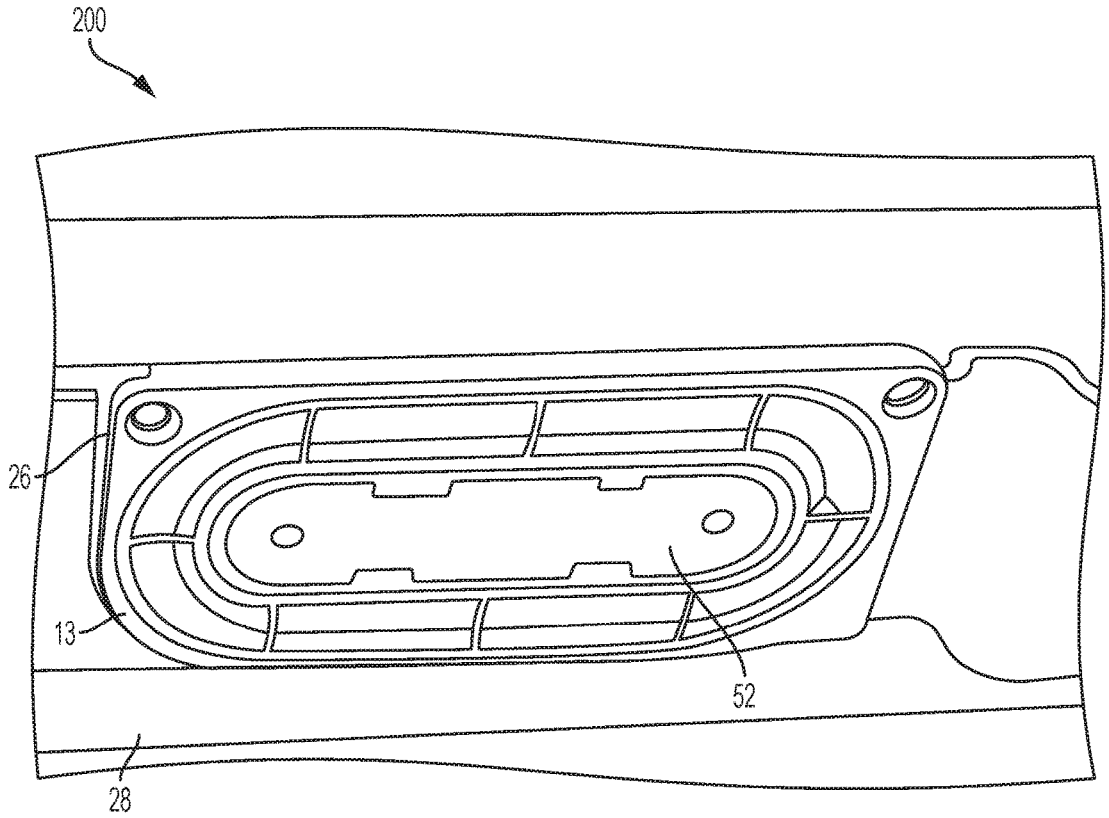
FIG. 16 is a schematic representation of a portion of an example acoustic system.

Although the previous embodiments describe systems comprising an acoustic transducer, aspects of the invention are applicable to other acoustic elements such as passive acoustic elements (e.g., a passive radiator). Referring to FIG. 16 is a schematic representation of an acoustic system 200, which may be a speaker assembly, comprising a housing 28 with an installed passive acoustic element 52 such as a passive radiator. The passive acoustic element 52 may comprise a frame 13 that facilitates positioning of the acoustic element within the housing.

Acoustic element 52 comprises a circumferential perimeter extending all around the device, which is positioned to interface or interact with the housing or other retaining structure when the acoustic element is installed in the housing. An acoustic element foam layer 26 is applied, installed, or manufactured along at least a portion of the length of the circumferential perimeter. The foam layer may be composed of any material configured or sufficient to be flexible to allow the acoustic element to be installed in a housing, but is sufficiently rigid to create an acoustic seal and/or prevent acoustic leak when the acoustic element is installed in the housing. As with the acoustic transducer embodiments, acoustic element 52 can be held in place within the frame by the compression of foam around the perimeter of the acoustic element. The acoustic element can be held in place by one or more card slots, and/or can be attached by one or more screws or other attachment mechanisms vertically through tabs molded into the frame.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. An acoustic system, comprising:

a housing comprising an acoustic element opening, the acoustic element opening comprising an inner edge extending from a first, outer surface of the housing to a second, inner surface of the housing; and an acoustic element comprising an acoustic element foam layer extending at least partially along a circumferential perimeter of the acoustic element, wherein the acoustic element foam layer is configured to engage the inner edge of the acoustic element opening when the acoustic element is positioned within the opening;

wherein the acoustic element foam layer is compressed in a direction perpendicular to a central axis of the acoustic element when the acoustic element is positioned within the opening, such that an acoustic seal is created, wherein the housing comprises a removable upper portion, the removable upper portion comprising a housing foam layer configured to align with at least a portion of the acoustic element opening when the acoustic element is positioned within the opening, such that an acoustic seal is created.

2. The acoustic system of claim 1, wherein the acoustic element is an acoustic transducer.

3. The acoustic system of claim 1, wherein the acoustic element is a passive acoustic element.

4. The acoustic system of claim 1, wherein the circumferential perimeter of the acoustic element comprises a substantially flat upper edge having a first end and a second end, and wherein the acoustic element foam layer comprises a first end and a second end, the first end of the acoustic element foam layer configured to be flush with the first end of the flat upper edge, and the second end of the acoustic element foam layer configured to be flush with the second end of the flat upper edge.

5. The acoustic system of claim 1, wherein the housing foam layer comprises a first portion configured to align with a first portion of the acoustic element foam layer, and further comprises a second portion configured to align with a second portion of the acoustic element foam layer, and wherein the housing foam layer extends along less than all of the length of a flat upper edge of the acoustic element.

6. The acoustic system of claim 1, wherein at least a portion of the inner edge of the opening comprises a ridge configured to compress the acoustic element foam layer when the acoustic element is positioned within the opening.

7. The acoustic system of claim 6, wherein the ridge is triangular.

8. The acoustic system of claim 1, wherein the acoustic element foam layer extends along the entire circumferential perimeter of the acoustic element.

9. The acoustic system of claim 1, wherein the acoustic element foam layer is wider than the inner edge of the opening.

10. The acoustic system of claim 1, wherein the acoustic element foam layer is approximately 1.5 mm thick.

11. The acoustic system of claim 1, wherein the acoustic element further comprises a flange portion configured to inhibit movement of the acoustic element relative to the outer surface of the housing.

12. The acoustic system of claim 11, wherein the flange portion is positioned in front of the opening when the acoustic element is positioned within the opening.

13. An acoustic system, comprising:

a housing comprising an acoustic element opening, the acoustic element opening comprising an inner edge extending from a first, outer surface of the housing to a second, inner surface of the housing, wherein the inner edge comprises a housing foam layer; and an acoustic element comprising a circumferential perimeter, wherein the circumferential perimeter of the acoustic element is configured to engage the housing foam layer of the opening when the acoustic element is positioned within the opening;

wherein the housing foam layer is compressed in a direction perpendicular to a central axis of the acoustic element when the acoustic element is positioned within the opening, such that an acoustic seal is created, wherein the housing comprises a removable upper portion, the removable upper portion comprising an upper housing foam layer configured to align with at least a portion of the acoustic element opening when the acoustic element is positioned within the opening, such that an acoustic seal is created.

14. The acoustic system of claim 13, wherein the acoustic element is an acoustic transducer.

15. The acoustic system of claim 13, wherein the acoustic element is a passive acoustic element.

16. The acoustic system of claim 13, wherein at least a portion of the circumferential perimeter of the acoustic element comprises a ridge configured to compress the acoustic element housing layer when the acoustic element is positioned within the opening.

17. The acoustic system of claim 16, wherein the ridge is triangular.

18. The acoustic system of claim 13, wherein the circumferential perimeter of the acoustic element comprises a substantially flat upper edge having a first end and a second end, and wherein the housing foam layer comprises a first end and a second end, the first end of the housing foam layer configured to be flush with the first end of the flat upper edge, and the second end of the housing foam layer configured to be flush with the second end of the flat upper edge.

19. The acoustic system of claim 13, wherein the upper housing foam layer comprises a first portion configured to align with a first portion of the housing foam layer, and further comprises a second portion configured to align with a second portion of the housing foam layer, and wherein the upper housing foam layer extends along less than all of the length of the flat upper edge of the acoustic element.

20. The acoustic system of claim 13, wherein the acoustic element housing layer is wider than the inner edge of the opening.

21. The acoustic system of claim 13, wherein the acoustic element housing layer is approximately 1.5 mm thick.

22. The acoustic system of claim 13, wherein the acoustic element further comprises a flange portion configured to align the acoustic element within the opening, the flange portion configured to be positioned in front of the opening when the acoustic element is positioned within the opening.

* * * * *